US008969267B2

(12) United States Patent
Rinklieb et al.

(10) Patent No.: US 8,969,267 B2
(45) Date of Patent: Mar. 3, 2015

(54) LUBRICANT COMPOSITIONS

(75) Inventors: Ronny Rinklieb, Korschenbroich (DE); Dirk Rettemeyer, Hückelhoven (DE); Markus Scherer, Köln (DE)

(73) Assignee: Cognis IP Management GmbH, Duesseldorf (DE)

( * ) Notice: Subject to any disclaimer, the term of this patent is extended or adjusted under 35 U.S.C. 154(b) by 399 days.

(21) Appl. No.: 13/497,574

(22) PCT Filed: Sep. 15, 2010

(86) PCT No.: PCT/EP2010/005670

§ 371 (c)(1), (2), (4) Date: Mar. 22, 2012

(87) PCT Pub. No.: WO2011/035865

PCT Pub. Date: Mar. 31, 2011

(65) Prior Publication Data

US 2012/0220508 A1 Aug. 30, 2012

(30) Foreign Application Priority Data

Sep. 23, 2009 (EP) ..... 09012058

(51) Int. Cl.

| | |
|---|---|
| ***C07F 9/02*** | (2006.01) |
| ***C10M 137/10*** | (2006.01) |
| ***C10M 105/34*** | (2006.01) |
| ***C09K 5/00*** | (2006.01) |
| ***C10M 169/04*** | (2006.01) |

(52) U.S. Cl.

CPC ..... *C10M 169/04* (2013.01); *C10M 2207/2805* (2013.01); *C10M 2207/2825* (2013.01); *C10M 2207/2835* (2013.01); *C10M 2207/2855* (2013.01); *C10M 2223/047* (2013.01); *C10N 2230/06* (2013.01); *C10N 2240/08* (2013.01); *C10N 2240/12* (2013.01); *C10N 2240/30* (2013.01)

USPC ..... 508/346; 508/369; 508/463; 252/68

(58) Field of Classification Search

USPC ..... 508/346, 369, 463; 252/68

See application file for complete search history.

(56) References Cited

U.S. PATENT DOCUMENTS

| | | | | |
|---|---|---|---|---|
| 4,175,045 | A | 11/1979 | Timony | |
| 2001/0038088 | A1* | 11/2001 | Schnur | 252/68 |
| 2007/0032391 | A1* | 2/2007 | Tagawa et al. | 508/421 |

FOREIGN PATENT DOCUMENTS

| | | |
|---|---|---|
| EP | 0903399 | 3/1999 |
| EP | 1529830 | 5/2005 |
| EP | 1734103 | 12/2006 |
| WO | WO-99/10455 | 3/1999 |
| WO | WO-00/11122 | 3/2000 |
| WO | WO-2009/116082 | 9/2009 |

OTHER PUBLICATIONS

"International Search Report of PCT/EP2010/005670", mailed on Feb. 4, 2011 , 5 pages.

* cited by examiner

*Primary Examiner* — Vishal Vasisth

(74) *Attorney, Agent, or Firm* — Servilla Whitney LLC

(57) ABSTRACT

Suggested is a method for enhancing energy efficiency of engines by applying to said engines a lubricant composition containing (A) carboxylic esters derived from the reaction of mono-, di- and/or poly alcohols with mono- and/or dicarboxylic acids, together with an additive blend (B) comprising at least two different additives (a) and (b) together, whereby compound (a) is selected from dithiophosphates, and compound (b) is selected from alkylated phosphorothionates, on condition that the total amount of the additive blend (B) is below 0.1 wt %, calculated on the weight of the whole composition.

16 Claims, No Drawings

LUBRICANT COMPOSITIONS

CROSS-REFERENCE TO RELATED APPLICATIONS

This application is the national stage entry of PCT/EP2010/005670, filed on Sep. 15, 2010, which claims priority to European Patent Application No. EP 09012058.5, filed on Sep. 23, 2009, both of which are incorporated herein by reference herein by reference in their entireties.

FIELD OF THE INVENTION

This invention relates to compositions, useful as lubricants, hydraulic or turbine oils, but in particular for the lubrication of compressors. By using compositions according to the present teaching energy consumption of machines running equipped with these compositions can be reduced.

STATE OF THE ART

Saving energy is an ongoing need in all kind of industrial and technical applications. A major cause for energy consumption is friction, which always occurs if solid parts of machines will come into contact under action. In many machines metal parts are rotating, and to avoid any friction lubricants will be used to lower this friction, and the energy which is used to overcome said frictional forces. Obviously, any reduction of friction in machines will also reduce energy consumption too. The present teaching is particularly directed to the improvement of lubricants to lower frictional forces, and also lower the energy consumption accordingly.

A typical machine with rotating solid part is a compressor. Compressors are widely known, and a broad variety of different types are known to the skilled in the art. A typical task for compressors is to carry gases, in particular air.

In this regard screw and the centrifugal compressors are used, but in particular rotary screw drive compressors are preferred for this kind of application. A screw drive compressor is a rotary compressor and contains of a housing including a bore, bearings, a low pressure end having a low pressure inlet and a high pressure end having a high pressure outlet. A rotor is rotably mounted by the bearings in the bore and has an end face subject to a variable axial thrust force. Those kinds of compressors are well known and will mostly used to carry and compress gases, mainly air. Screw compressors will generate a pressure up to 30 bar, whereby in the mid range a pressure of up to 20 bar is produced.

The functionality of oil in a screw compressor based on the main needs to take the compression heat out, seal the rotors, lubricate the moving parts and protect against corrosion. Air compressor oils for oil injected screw compressors based on mineral oil as the common standard. More efficient oils in ambitious applications based on polyalphaolefins (PAO) as base oil. Partially Ester based formulations are described in these application too. WO 1999/10455 A1 describes mixtures from different polyol esters as lubricant/coolant for rotary crew compressors. U.S. Pat. No. 4,175,045 disclose esters from polyols with carboxylic esters with 4 to 13 C-atoms for the same purpose.

To generate a longer life under the given conditions from high temperature, high pressure and facing oxygen it is necessary to protect all kinds of base oils against oxidation and aging processes. This will be covered by known phenoloic- and aminic-antioxidants as well as other radical interceptors. Known anti corrosion additives will protect against corrosion. The air release of common products is specified with less than 10 minutes and usually in the range of less than three minutes or even less. To produce compressed air in industrial applications are mainly screw compressors active. By their need to provide compressed air usually around the clock, energy consumption is the reason for expensive maintenance. I was therefore one of the objectives of the present invention to enhance the energy efficiency of such kind of compressors, which means to improve either the amount of gas, which could be compressed with a given amount of energy, or to lower the amount of energy necessary to compress a given amount of gas.

DESCRIPTION OF THE INVENTION

It was found that a certain lubricant composition containing a specific selection from additives in certain low amounts solves this problem.

The first embodiment of the present application is directed to method of enhancing the energy efficiency of engines by applying to said engines a lubricant composition containing (A) carboxylic esters derived from the reaction of mono-, di and/or poly alcohols with mono- and/or dicarboxylic acids, together with an additive blend (B) comprising at least two different additives (a) and (b) together, whereby compound (a) is selected from dithiophosphates, and compound (b) is selected from alkylated phosphorothionates, on condition that the total amount of the additive blend (B) is below 0.1 wt %, calculated on the weight of the whole composition.

The gist of the present invention is the surprising finding that the choice of a specific additive blend, but only if used in unusual low amounts, will increase the energy efficiency of lubricants, hydraulic and turbine oils, and in particular lubricants operated in compressors.

The compositions according to the present teaching contain two compelling compounds, which is (A) an ester based base fluid, and (B) an additive blend as defined above, with the proviso that (B) is present in amounts of less than 0.1% by weight based on the weight of the total composition. It is essential for carrying out the present invention, that the additive blend (B) comprises at least the two different components (a) and (b) together.

Although the use of additives is well know in the art, it is surprisingly to find, that very low amounts of such additives could advantageous influence the properties of the compositions. The use of additive packages itself is known to the skilled person, for example from EP 1529830 A1 or EP 1734103 A1, describing lubricant oils is equipped with an additive package too. The latter document EP 1734103 A1 will not disclose the teaching of the present invention, that a relatively small amount of additives could enhance the energy efficiency of said lubricants under operation conditions. Furthermore, EP 1734103 A disclose as compelling additive one selected from the so-called component (C-1) and/or component (C-2) in claim 1 of this document as follows:

Component C-1

Component C-1is at least one kind of a compound represented by the following formulas (1) to (3):

$$R^1CO—NR^2—(CH_2)_nCOOX^1 \quad (1)$$

wherein $R^1$ is an alkyl group having 6 to 30 carbon atoms or an alkenyl group having 6 to 30 carbon atoms, $R^2$ is an alkyl group having 1 to 4 carbon atoms, $X^1$ is hydrogen, an alkyl group having 1 to 30 carbon atoms or an alkenyl group having 1 to 30 carbon atoms, and n is an integer of 1 to 4, $$[R^1CO—NR^2—(CH_2)_n—COO]_mY^1 \quad (2)$$

wherein $R^1$ is an alkyl group having 6 to 30 carbon atoms or an alkenyl group having 6 to 30 carbon atoms, $R^2$ is an alkyl group having 1 to 4 carbon atoms, $Y^1$ is an alkali metal or an alkali earth metal, n is an integer of 1 to 4, and m is 1 when $Y^1$ is an alkali metal and 2 when $Y^1$ is an alkali earth metal, and $$[R^1CO—NR^2—(CH_2)_nCOO]_m—Z—(OH)^{m'} \quad (3)$$

wherein $R^1$ is an alkyl group having 6 to 30 carbon atoms or an alkenyl group having 6 to 30 carbon atoms, $R^2$ is an alkyl group having 1 to 4 carbon atoms, Z is a residue having a hydroxyl group removed from a polyhydric alcohol with two or more valences, m is an integer of 1 or more, m' is an integer of 0 or more, m+m' is a valence number of Z, and n is an integer of 1 to 4;

Component C-2

Component C-2 is a compound represented by the following formula (4):

$$R^3—CH_2COOH \quad (4)$$

wherein $R^3$ is an alkyl group having 7 to 29 carbon atoms, an alkenyl group having 7 to 29 carbon atoms or a group represented by the formula (5):

$$R^4—C_6H_4O— \quad (5)$$

wherein $R^4$ is an alkyl group having 1 to 20 carbon atoms or hydrogen;

The co-use of components, falling within the description of components C-1 and/or C-2 as describe before is nor preferred and could be excluded. In particular, the co-use of N-Oleyl sarcosine and/or of nonyl phenoxyacetate is not of advantage and to preferably the use of these particular components is outside the scope of the present invention and could therefore be exclude.

The compositions are useful as lubricants but can also used with advantage as hydraulic oils, or as turbine oils. However, the use as lubricant is the primary use is according to the present teaching.

The Ester

All kind of esters are in general known base oils for lubricants, hydraulic or turbine oils. Compound (A) of the compositions according to the present teaching are known esters of carboxylic acids or could be derived from natural sources.

These esters are available by all known preparation methods, and preferably from the reaction of an acid with an alcohol. The alcohol is an organic mono alcohol, diol or a polyol respectively. The acid part is selected from organic mono- or dibasic acids. "Organic" means that the alcohol, as well as the acid, contains carbon atoms. However, carbonates are not falling within the definition of an "organic" compound.

Suitable acids for the preparation of the esters are on the one hand monocarboxylic acids of the general formula R'—COOZ, wherein R' is a linear, branched, cyclic, aromatic or saturated or unsaturated moiety with 1 to 30 C-atoms. Preferred acids of this type are saturated or branched ones, especially those acids with from 6 to 22 C-atoms. Also any blends of this acid type can be used to prepare esters in accordance with the present technical teaching.

is then selected from the group of linear or branched, saturated or unsaturated, cyclic or aromatic di-acids. Blends of various types of those esters can also be used with advantage. Typical saturated dicarboxylic acids are oxalic acid, malonic acid, succinic acid, glutaric acid, adipic acid, pimelic acid, azelaic acid and sebacic acid. Unsaturated dicarboxcylic acids are for examples fumaric and maleic acid, itaconic and muconic acid. Examples of aromatic acids are phthalic and terephthalic acid. It is also possible to prepare esters according to the teaching of this invention by using all kind of blends of the acids as described above.

However, the preferred dibasic acids are those with 6 to 10 C-atoms in total, for example succinic acid, adipic acid, pimelic acid, nonanedioic acid (azelaic acid), and most preferred decanedioic acid (sebacic acid). These acids are known, as well as methods for their full or partial esterification by acid or base catalyst reactions.

The preferred diacids according to the invention could be full or partially esterified, or the compositions contain both kind of ester together in any weight ratio. It is preferred to use full esterified acids (=diesters) accordingly. However, due to the reaction conditions a small amount of mono-esters might be present, as well as small amounts of non esterified acids. Small amounts in accordance with the present teaching are values below 15 wt %, preferably below 10 wt % or below 5 wt %. Most preferred are lower amounts, like below 1.0 wt-% or below 0.1 wt % too. But it is also preferred to use the diesters only and to limit the amount of monoesters and also of free acids to the lowest extend possible.

The alcohol part of the esters is broadly selected from mono- di- or poly alcohols. The alcohols might be linear or branched, saturated or unsaturated, as well as cyclic or aromatic ones too.

Alkyl alcohols might be in a preferred embodiment being selected from the group of linear or branched, saturated or unsaturated alkyl mono alcohols with 1 to 31 C-atoms, diols with 2 to 25 C-atoms or polyols. Linear mono alcohols are for example are methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol tricontanol or hentriacontasol. In these alcohols the OH-functionality is located in the "1" position, but all isomers thereof are also suitable. The same applies in accordance with all kind of branched isomers of the above alcohols. Preferred branched alcohols are the so called Guerbet-alcohols. Unsaturated mono alcohols are for example oleic alcohol, linoleic alcohol, 9Z- and 9E-octadec-9-en-1-ol, (9Z,12Z,15Z)-octadeca-9,12,15-trien-1-ol, (9Z)-eicos-9-en-1-ol, or 13E- or 13Z-docosen-1-ol.

Furthermore, diols, preferable glycols, including their oligomers or polymers are suitable alcohols for preparing esters according to the present invention. Ethylene glycol or diethylene glycol, or their oligomers and propane and butane diols are preferred members. Polyols are also suitable alcohol components. Preferred examples are glycerol, oligo- or polyglycerol, trimethylolpropan and pentaerythritol, as well as oligomers or polymers thereon. It is also possible to prepare esters according to the teaching of this invention by using all kind of blends of the alcohols as described above. A preferred class of alcohols is selected from branched mono alcohols, preferably selected from such branches alcohols with 6 to 12 C-atoms. Preferred are the branched ones with in total 6 to 10 C-atoms. Most preferred is 2-ethylhexanol as alcohol and isononanol. Those branched alcohols are commercial available.

The present invention also encompasses polyol esters and blends thereof having as essential constituents esters of sterically hindered polyols with linear or branched alkanols, known as "complex esters". As an examples, a neopentyl glycol ester of at least one, monocarboxylic carboxylic acid having from 7 to 10 carbon atoms and of at least one other ester of a different hindered polyol with a monocarboxylic carboxylic acid having from 5-10 carbon atoms is mentioned.

In a preferred form the lubricant base fluid comprising a blend of polyol esters having as essential constituents from 30-60% by weight of neopentylglycol ester of at least one monocarboxylic 70 alkanoic acid having from 7-10 carbon atoms and from 40-70% by weight of at least one other ester of a hindered polyol selected from esters of trimethylolpropane, trimethylolethane, trimethylolbutane, and pentaerythritol with a monocarboxylic alkanoic acid having from 5 to 10 carbon atoms, said percentages being by weight of the total quantity of hindered polyol ester. A suitable base fluid comprises 40-45% by weight of the neopentyl glycol ester and 55-60% by weight of the trimethylol or pentaerythritol ester. When a pentaerythritol ester is used with the neopentylglycol ester, carbon chain length of the etherifying acid is preferably from 5 to 10, while with the trimethylol alkane ester, the acid preferably has a chain length of 7 to 10 carbon atoms.

Other esters suitable for use in lubricant base fluids and recognized for such purpose may are 2,2,4-trimethylpentane, 1,3-diol-dipclargonate, di-2-ethylhexylazelate, diisodecyladipate, diisooctylsebacate, isodecylpelargonate, diethyleneglycol dipelargonate and mixtures of the same.

Not preferred is the use of such ester, which bases on non-edible vegetable oils, like ricebran oil or derivatives thereto.

With certain advantage the ester compound (A) contains at least one dibasic ester, and particularly these dibasic esters are derived from dicarboxylic acids, according to the following general formula (I)

$$\text{HOOC—X—COOH} \quad \text{(I)}$$

whereby X represents a divalent moiety which is saturated or unsaturated, linear, branched, cyclic or aromatic and contains from 1 to 30 C-atoms, or salts thereto.

In a further preferred embodiment esters (A) according to the general formula (II) are used $$\text{ROOC—}(\text{CH}_2)_n\text{—COOR'} \quad \text{(II)}$$

wherein R and R' represents, independently from each other a branched, saturated or unsaturated alkyl moiety with 4 to 12 C-atoms, and the index n has an value from 1 to 22, and preferably from 6 to 18, and most preferred n is 6 to 12 or 8 to 10, and most preferred n is 8.

A preferred ester compound (A) comprises only said dibasic esters according to formula (II), whereby small amounts of free acids or other byproducts may be present, preferably in amounts below 10% by weight, below 5.0% by weight, and most preferred below 1.0% by weight.

The esters according to formula (II) are di-esters too and both carboxylic acids groups are preferably esterified. These diesters are prepared by standard reactions from the carboxylic acids and the alcohols in the presence of an acidic or basic catalyst at elevated temperatures and/or elevated pressure.

Due to the reaction conditions a small part of the esters could be the monoester derivative, but not more than 5.0% by weight; preferred are amounts of free alcohols in the range from 0.01 to 3.0% by weight, and more preferred 0.1 till 1.0% by weight, based on the total weight of all esters. Typically, esters according to the present teaching show OH-numbers of less than 5, but preferably less than 3 or even 1 or less.

The ester, which could be used for carrying out the present invention show preferably a selected cinematic viscosity, which is between 10 and 100 $mm^2/s$ (at 40° C.), and more preferred between 20 and 50 $mm^2/s$ (at 40° C.)—measured in accordance with DIN 51562, T1.

The present teaching encompasses the use of esters according to the above description, and preferred those of formula (II) alone, or in combination with other suitable base fluids, like poly alpha olefins (PAO), internal olefins (IOs), or polyolesters, all kind of mineral oils, whereby so called hydroracked oils, and other paraffin or naphthenic mineral oils (and their blends) could be preferred, including diesel oil, and polyalkylene glycols.

If such blends are used the majority of the base fluid is a dibasic esters according to formula (I), which means at least 50% by weight, whereby amounts of 70 to 90, and more preferred 80 to 95% by weight are of advantage. A typical blend may contain 10% by weight of a PAO and 90% by weight of an ester, preferably of esters according to formula (II), or any blends thereof.

Additive Component (a)

The second compounds of the lubricant compositions according to the present teaching are dithiophosphate derivatives, following the general formula (III)

$$[R_1O]_2\overset{\overset{\displaystyle S}{\|}}{P}\text{—S—}R^2 \quad \text{(III)}$$

Wherein $R^1$ is an alkyl moiety (branched, linear, saturated or unsaturated), which can be interrupted by 1 or two oxygen atoms, containing from 1 to 12 C-atoms, or a $C_6$-$C_{10}$ aryl (substituted with at least one $C_1$-$C_{12}$ alkyl group, or unsubstituted) group. Whereby the both $R^1$ groups are identical, or different from each other, and $R^2$ represents either a group $(CH_2)_n$—COOX, wherein X is a hydrogen atom, or a cation, and n has a value from 1 to 10, or groups OH, $NR_3R_4$, $NHCH_2COOX$, $NHCH_2COOR^3$, $N(CH_2\text{—}COOX)_2$, $N(CH_2\text{—}COOR^3)_2$, $NHCH_2OH$, $N(CH_2CH_2OH)_2$.

X has the same meaning as above. $R^3$ and $R^4$ represent independently from each other a $C_1$-$C_{18}$ alkyl or alkenyl group, which can be interrupted by oxygen, nitrogen and/or sulphur atoms. X stands preferably for a hydrogen atom or —OH or —$NR^3R^4$. In general such additives are advantageous which can be qualified as "ashless". The ones with X equals H are such ashless additives. These compounds are also known, especially as anti-wear or high pressure additives in lubricant compositions. Various additives of this type are commercial available.

U.S. Pat. No. 4,333,841 discloses various compounds of this type (a), as well as their preparation, and those are also suitable for the compounds of the present invention. Especially reference in made to claim 1 of U.S. Pat. No. 4,333,841 as well as specifically to the members disclosed in table 1 on columns 3 to 10 respectively. Rohm and Haas provides such additives under the brand Primene™, like Primene™ 81-R or Primene™ JM-T which are also disclosed in Table 1 of U.S. Pat. No. 4,333,841 on columns 9 and 10. From EP 1529830 A1 additive packages containing thiophosphates and dithiophosphates are known, but these additives are said to be unexpected compatible to calcium ions present in a lube composition.

Additive Component (b)

This kind of compounds is known as derivatives of triphenyl phosphorothionates, and will be also used as extreme pressure and anti-wear agent. Compounds according to the general formula (IV)

$$[R^2\text{—Ar—O}]_3\text{P=S} \quad \text{(IV)}$$

are preferred in the meaning of the present teaching. $R^2$ represents a $C_1$-$C_{18}$ alkyl moiety (linear or branched, saturated or unsaturated), and Ar is a C6-aromatic group, i.e. a benzyl group, which is substituted by at least one R-group. R is preferably a linear alkyl group with 8 to 18, preferably 8 to 12 C-atoms.

Both additives (a) and (b) are mandatory for enabling the present teaching. It is preferred to use the additives (a) and (b) together in amounts from 0.001 to 0.099% by weight and more preferred from 0.01 to 0.09% by weight. Specific preferred ranges are selected from 0.02. to 0.090% by weight, 0.03 to 0.090% by weight and 0.05 to 0.090% by weight. It should be noted, that the compounds (a) and (b) can comprise by-products or solvents. Regularly, this additional compounds are present in amounts from at maximum 10% by weight, calculated on the total weight of the blend of (a) and (b), and preferably below 5% by weight or lower, for example below 1% by weight, or even zero.

It is possible to use the compounds (a) and (b) in different amounts together, preferred in the weight ratio (a):(b) from 3:1 to 1:3, and preferred from 2:1 to 1:2. But most preferred is the ration of about 1:1 of each of the additives (a) and (b). In a preferred embodiment, the additive compound (B) consists only from the blend of (a) and (b). Preferably, only those additives of type (a) and (b) are selected, which do not contain metal atoms.

The compositions of the present invention may contain further additives (which are structural different to either (a) and/or (b)), like antioxidants, corrosion inhibitors (or anti-rust additives), foam inhibitors, preservatives and yellow metal deactivators, friction modifiers and viscosity modifiers and viscosity index (VI) improvers.

Antioxidation additives that may be used as a component of the lubricant composition include phenolic and amine antioxidants and mixtures thereof. The phenolic antioxidants which may be include oil-soluble, sterically hindered phenols and thiophenols. Included within the definition of phenolic and thiophenolic antioxidants are sterically hindered phenolics such as hindered phenols and bis-phenols, hindered 4,4'-thiobisphenols, hindered 4-hydroxy- and 4-thiolbenzoic acid esters and dithio esters, and hindered bis(4-hydroxy- and 4-thiolbenzoic acid and dithio acid) alkylene esters. The phenolic moiety may be substituted in both positions ortho to the hydroxy or thiol groups with alkyl groups which sterically hinder these groups. Such alkyl substituents usually have 3 to 10 carbons, suitably 4 to 8 carbons, with one alkyl group generally being branched rather than straight-chain (e.g., t-butyl, t-amyl, etc.). The compositions according to the present teaching may typically contain one antioxidant additive. However, combinations of the foregoing antioxidant additives may also be used.

The anti-rust additive component may include a combination of ionic and non-ionic surface active anti-rust ingredients. The total amount by weight of ionic and non-ionic surface active anti-rust additive necessary to impart the desired degree of rust resistance may be significantly less than either anti-rust additive independently. Ionic anti-rust lubricating additives which may be used in the compositions described herein may include phosphoric acid, mono and dihexyl ester compounds with tetramethyl nonyl amines, and C10 to C18 alkyl amines. Non-ionic anti-rust lubricating additives which may be used in the compositions described herein may include fatty acids and their esters formed from the addition of sorbitan, glycerol, or other polyhydric alcohols, or polyalkylene glycols. Other non-ionic anti-rust lubricating additives may include ethers from fatty alcohols alkoxylated with alkylene oxides, or sorbitan alkoxylated with alkylene oxides, or sorbitan esters alkoxylated with alkylene oxides. Examples of suitable non-ionic anti-rust lubricating additives include: sorbitan mono-oleate, ethoxylated vegetable oil, isopropyl oleate, ethoxylated fatty acids, ethoxylated fatty alcohols, fatty glyceride esters, polyoxyethylene sorbitan mono-oleate, polyoxyethylene sorbitan, glycerol mono-oleate, glycerol di-oleate, glycerol mono-stearate, and glycerol di-stearate.

In some embodiments, corrosion inhibitors may constitute another class of additives suitable for inclusion in the compositions described herein. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. Suitable compounds include the 1,3,4-thiadiazoles, a number of which are available as articles of commerce, combinations of triazoles such as tolyltriazole with a 1,3,5-thiadiazole such as a 2,5-bis(alkyldithio)-1,3,4-thiadiazole, and bis-alkyl-arylalkyl benzotriazole alkylamines such as N,N-bis(2-ethyl)armethyl-1H-benzotriazole-1-methanamine. The amount of corrosion inhibitor in the formulations described herein may range from about 0.01 to about 1.0% by weight, whereby the range from 0.2 to 0.5% by weight could be of advantage too, based on the total weight of the lubricant composition.

Foam inhibitors may be selected from silicones, polyacrylates, methacrylates, surfactants, ethylene-propylene block copolymers, and the like. The amount of antifoam agent in the formulations described herein may range from about 0.0025% by weight to about 0.1% by weight based on the total weight of the lubricant composition. 0.01% by weight is a more preferred maximum amount of these kinds of additives.

It is also known that these lubricant oils are incorporated with a viscosity index (VI) improver, such as ethylene/-olefin copolymers and poly(meth)acrylates, to improve their viscosity and temperature characteristics. Additives of this kind are for examples selected from the Viscoplex® series by Evonik, i.e. Viscoplex Series 8 or 10, are know to the skilled in the art for this purpose.

Thickeners for use in the compositions according to the present invention are for example ethylene/propylene/styrene copolymers, butylene/ethylene/styrene copolymers; commercial products like Versagel M750, Versagel ME 750, Versagel MP 500, Versagel MD 1600, available from Penreco; Transgel 105 and Transgel 110 available from Rita; polyisobutylene, hydrogenated polyisobutylene, waxes, such as polyethylene wax, beeswax and the like: oil-soluble polyacrylates, oil soluble poly(meth)acrylates, ethylene-propylene co-polymers, functionalized olefin copolymers, olefin terpolymers and functionalized olefin terpolymers, hydrophobically modified clays, silicas, and copolymers of styrene and olefins.

In addition to the additives (a) and (b) structural different anti-wear or high-pressure/extreme-pressure additives ("EP additives") may be present in the lubricant compositions too. In these cases typical amounts are ranging from 0.1 to 5.0% by weight or 0.5 to 2.5% by weight in total.

Additives used in formulating the compositions described herein may be blended into the base oil individually or in various sub-combinations. However, it is suitable to blend all of the components concurrently using an additive concentrate (i.e. additives plus a diluent, such as the base oil). The use of an additive concentrate takes advantage of the mutual compatibility afforded by the combination of ingredients when in the form of an additive concentrate. Also, the use of a concentrate reduces blending time and lessens the possibility of blending errors.

In preparing a formulated compressor lubricant composition, the additives may be added directly to the ester compound and mixed sufficiently to achieve a uniform distribution. In some cases, it is desirable to heat the ester prior to addition of the additives to facilitate solution of the additives in the ester. It is also desirable as an alternative, in some cases, to form an "additive package" for subsequent addition to the ester. Such additive packages may be prepared by, for example, mixing the additives together in a suitable solvent. Suitable solvents for this purpose include mineral oils, benzene, diesel oils, toluene, octane, polyol esters, and the like.

A further embodiment of the present invention pertains to a composition, containing from 90 to 99% by weight of an ester compound (A) according to the above description, and from 0.01 to 0.099% by weight an additive package (B) containing the additives (a) and (b) according to the above description, whereby (a) and (b) are present in a weight ratio of 2:1 to 2:1 and preferred 1:1, and the rest up to 100% by weight are other additives. Preferred are such compositions containing a dicarboxylic acid ester according to formula (II) above.

Furthermore, a compressor is claimed, running with a lubricant composition as described in the above. A rotary screw drive compressor is a preferred embodiment. In this regard the compressor will preferably generate a pressure of 20 bar at maximum, whereby a typical range is from 10 to 20 bar or 12 to 18 bar.

The use of the above characterized compositions is able to lower the energy consumption of a rotary screw compressor up to at maximum 20%, if compared to a compressor running with a standard oil. Enhancements are for example in the range from up to 15%, 10% or 5%, or 3 to 5%, compared with the same compressor, operated with a standard lubricant of the known art is also a preferred value. In this respect a standard lubricant is RotoXtend by Atlas Copco. Therefore, the enhancement of energy efficiency of engines, where moving parts need lubrication, especially of compressors, and more preferred of screw drive compressors by using compositions according to the above description is also an embodiment of this invention.

Furthermore, a method for the improvement of energy efficiency of a lubricant composition, whereby one uses an additive blend, comprising at least two different additives, selected from (a) dithiophosphates, and (b) alkylated phosphorothionates, whereby the total amount of the additive blend is below 0.1 wt %, calculated on the weight of the whole composition is a preferred embodiment of the present application. The improvement can be shown by comparison with the same composition which is free of the additive blend.

The compositions according to the present invention also show low shear losses; excellent air release properties and very efficient anti wear properties by combination of sec. and tert. thiophosphates. The high pressure viscosity is unusually high in this formulation. Performing under high air entrainment is lower than 1 minute in air release tester.

EXAMPLES

Example A

Comparative Examples C1 to C4

To show the superior properties of the claimed composition test have been conducted. Four lubricant compositions C1-C4 have been prepared, and were compared to a composition (A) according to the teaching of the present invention. Details could be determined from the following table 1. C1 is a commercially available lube composition from Atlas Copco, called Roto Xtend.

Compositions C4 and A both contained a blend from dithiophosphate and triphenylphosphorothionate in accordance with the present invention in amounts to below 0.09 g (called Additive blend in below table 1).

TABLE 1

Lubricant compositions (all values in g)

| Composition | C2 | C3 | C4 | A |
|---|---|---|---|---|
| Syndative DEHS | 83.3 | 88.3 | | 83.12 |
| PAO 8 | | | 96.12 | |
| Viscoplex 8-100 | 13 | | | 13 |
| Viscoplex 8-800 | | 8 | | |
| Antioxidant | 3 | 3 | 3 | 3 |
| EP Additive | 0.5 | 0.5 | 0.5 | 0.5 |
| Metal deactivator | 0.05 | 0.05 | 0.05 | 0.05 |
| Corrosions inhibitor | 0.1 | 0.1 | 0.1 | 0.1 |
| Antifoam agent | 0.05 | 0.05 | 0.05 | 0.05 |
| Additive blend | No | No | Yes | Yes |

Synative® DEHS 2-ethylhexyl-diester of sebacic acid (Cognis)

Nexbase 2008 Decen-1 Homopolymer, hydrated

Viscoplex® 8-100 Polymer (Degussa)

Viscoplex® 8-800 Polymer (Degussa)

In table 2 viscosity data, measured at 100° C. and 40° C., and the Viscosity Index (VI) are shown:

TABLE 2

Viscosity data

| | C1 | C2 | C3 | C4 | A |
|---|---|---|---|---|---|
| Viscosity at 100° C. $mm^2/s$ | 7.43 | 7.00 | 9.24 | 7.85 | 7.01 |
| Viscosity at 40° C. $mm^2/s$ | 43.35 | 28.51 | 34.44 | 46.66 | 28.2 |
| VI | 137 | 223 | 268 | 138 | 227 |

To show the enhancement of energy efficiency test have been conducted in accordance with ISO 1217 with a standard screw compressor (Atlas Copco GAS-7,5 EZP). In the course of the tests the compressor where operated over 4 h each with different lubricant compositions C1, C2 and A respectively. The volume of carried air was measured. In table 3 a comparison between the carried volume with C1 and C2 and the carried volume with A is shown on a percentage basis. Values above zero show better performance of A.

TABLE 3

Carried volumes

| Temperature | % Differences compared to C1 | % Differences compared to C2 | % Differences compared to C4 |
|---|---|---|---|
| 70° C., 3 bar | 2.25 | 3.37 | 0.03 |
| 70° C., 5 bar | 7.02 | 6.63 | 3.33 |
| 90° C., 3 bar | 0.15 | 2.35 | 1.16 |
| 90° C., 5 bar | 0.76 | 2.98 | 0.71 |

It is apparent, that the use of a lubricant according to the present invention (A) will under the majority of the tested conditions enhance the performance of the equipment, and, if the same volume of air is concerned will lower the amount of used energy. These results also clearly show that the enhancements are subject to the choice of both, small amounts of a specific additive package, and the choice of a certain kind of ester base oil.

In a further test the load characteristics of the various compositions have been tested according to DIN ISO 51350. The results are shown in table 4:

TABLE 4

| | Composition | Load (n.d. = non detectable) 500N | 600N | 700N |
|---|---|---|---|---|
| (1) | Syndative DEHS plus 0.5 wt % Additive (b) | 0.8 | 0.9 | n.d. |
| (2) | Syndative DEHS plus 0.5 wt % Additive (a) | 0.5 | 0.6 | 3.0 |
| (3) | Syndative DEHS plus 0.9 wt % Additive (a) | 2.6 | n.d. | |
| (4) | Syndative DEHS plus 0.09 wt % Additives (a) and (b) ratio 1:1 | 0.4 | 0.5 | 1.9 |

This result shows that the compositions according to the present invention also show superior lubricant properties, compared to similar compositions with low amounts of additives.

The invention claimed is:

1. A method for enhancing the energy efficiency of engines by applying to said engines a lubricant composition containing (A) from 90 to 99% by weight carboxylic esters derived from the reaction of mono-, di and/or poly alcohols with a dicarboxylic acid according to the general formula (I):

$$HOOC—X—COOH \quad (I)$$

wherein X represents a divalent moiety which is saturated or unsaturated, linear, branched, cyclic or aromatic and contains from 1 to 30 C-atoms, together with from 0.01 to 0.099% by weight an additive blend (B) comprising at least two different additives (a) and (b) together, whereby compound (a) is selected from dithiophosphates, and compound (b) is selected from alkylated phosphorothionates, and wherein the additives (a) and (b) are present in a weight ratio from 2:1 to 1:2, calculated on the weight of the whole composition.

2. The method of claim 1, whereby the alcohol part of said carboxylic acid ester (A) is selected from the group of linear or branched, saturated or unsaturated alkyl mono alcohols with 1 to 31 C-atoms, diols with 2 to 25 C-atoms, and polyols selected from the group glycerol, neopentylglycol, oligo- or polyglycerol, trimethylolpropane and pentaerythritol, as well as oligomers or polymers thereon.

3. The method of claim 1, whereby the alkyl group of said alcohol part of the carboxylic acid esters (A) is selected from branched, saturated alkyl groups. The method of claim 1 whereby said carboxylic acid ester is selected from the group consisting of complex esters, derived from the reaction of a polyol with a mixture of at least two different carboxylic acids.

4. The method of claim 1, whereby X in formula (I) represents a linear or branched alkyl or unsaturated alkenyl moiety with 1 to 22 C-atoms.

5. The method of claim 1, whereby said carboxylic acid esters (A) are mono- or diesters.

6. The method of claim 1, whereby the dicarboxylic acid ester is represented by general formula (II)

$$ROOC—(CH_2)_n—COOR' \quad (II)$$

wherein R and R' represents, independently from each other, a branched, saturated or unsaturated alkyl moiety with 4 to 12 C-atoms, and the index n has a value from 6 to 18.

7. The method of claim 6, whereby both groups R and R' in formula (II) represent a 2-ethylhexyl group.

8. The method of claim 6, whereby the index n in formula (II) has the value of 6 to 8.

9. The method of claim 1, whereby said engines are compressors.

10. The method of claim 9, whereby said engines are screw drive or centrifugal compressors.

11. The method of claim 9, whereby said carboxylic acid esters (A) show a dynamic viscosity of 20 till 50 $mm^2/s$.

12. The method of claim 9, whereby said engines are both additives (a) and (b) are free of metal atoms.

13. The method of claim 9, whereby said engines are said composition are free of N-oleyl sarcosine and/or of nonyl phenoxyacetate.

14. A lubricant composition containing from 90 to 99% by weight of an ester as defined in claim 1, and from 0.01 to 0.099% by weight an additive package containing the two additives (a) and (b) together in a weight ratio of 1:1, and the rest up to 100% by weight are other lubricant additives.

15. A compressor containing as lubricant a composition as defined in at least one of the claim 1.

16. The method of claim 10, whereby said engines are rotary screw drive compressors.

* * * * *